United States Patent [19]

Baribault, Jr.

[11] Patent Number: 4,847,932

[45] Date of Patent: Jul. 18, 1989

[54] METHOD AND APPARATUS FOR RECEIVING FLUIDS AND WASTES OF A BEDRIDDEN PATIENT

[76] Inventor: Louis J. Baribault, Jr., 5600 Jacobson Rd., Sandpoint, Id. 83864

[21] Appl. No.: 194,278

[22] Filed: May 16, 1988

[51] Int. Cl.[4] ..... A61G 7/02

[52] U.S. Cl. ..... 5/463; 4/452

[58] Field of Search ..... 5/463, 91, 90, 484, 5/486, 487; 4/451, 452

[56] References Cited

U.S. PATENT DOCUMENTS

| | | | |
|---|---|---|---|
| 759,882 | 5/1904 | Paddleford | 5/90 |
| 760,755 | 5/1904 | Radcliff | 5/463 |
| 801,667 | 10/1905 | Kintz | 5/463 X |
| 1,107,683 | 8/1914 | Malarkey | 5/463 |
| 2,157,394 | 5/1939 | Beery | 5/463 X |
| 2,585,861 | 2/1952 | Small et al. | 5/484 |
| 2,644,957 | 7/1953 | Shudde | 5/463 |
| 4,011,610 | 3/1977 | Parker | 5/463 X |

*Primary Examiner*—Gary L. Smith
*Assistant Examiner*—Michael J. Milano
*Attorney, Agent, or Firm*—Henderson & Sturm

[57] ABSTRACT

An apparatus for receiving fluids and wastes of a bedridden patient including a mattress with an elongated cavity generally in the middle portion, the cavity being the depth of the mattress and having an upper edge defined by the top surface of the mattress adjacent the cavity. A plug is selectively movable between an inserted position, which inserted position fills the cavity and makes the top surface of the mattress even. When the plug is in the retracted position, the cavity is open. A bottom sheet fitted over the mattress has a head portion, a foot portion and sides which cover the mattress. The bottom sheet also includes an opening registerable with the cavity in the mattress. An auxiliary short sheet is fitted over the bottom sheet and includes a body section that extends at least half way down the mattress to cover the plug. A waste container is also provided for inserting into the cavity of the mattress when the cavity is open. The invention further provides a method for receiving fluids and wastes from a bedridden patient which includes positioning the patient on the apparatus. The auxiliary short sheet is moved to expose the plug and the patient is positioned with legs astraddle the plug. The plug is removed from the cavity and the waste container is placed in the cavity and slid up under the patient. After the patient has deposited body wastes in the container, the container is removed and the plug reinserted into the cavity opening. The auxiliary short sheet is then placed back in position to cover the plug.

1 Claim, 4 Drawing Sheets

Fig. 4
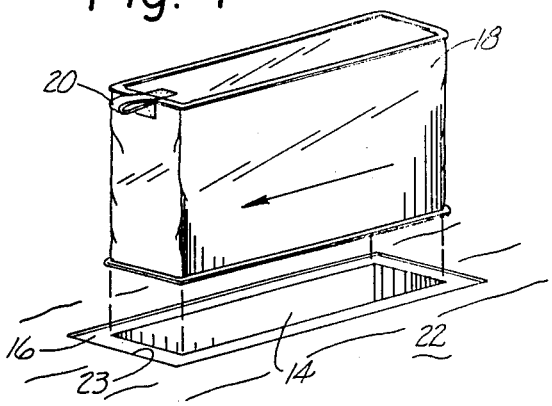
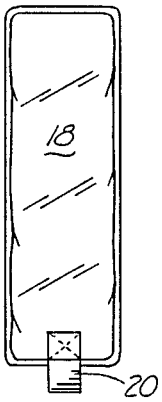
Fig. 5
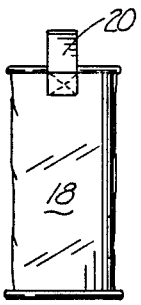
Fig. 6
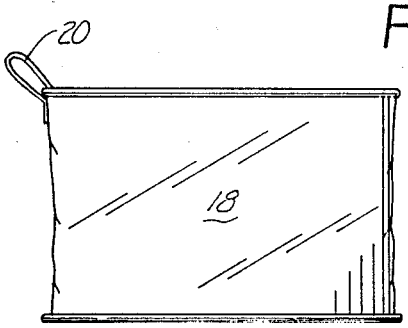
Fig. 7

METHOD AND APPARATUS FOR RECEIVING FLUIDS AND WASTES OF A BEDRIDDEN PATIENT

TECHNICAL FIELD

This invention relates to mattresses for receiving a bed pan, and more particularly to a method and apparatus for receiving fluids and wastes of bedridden patients.

BACKGROUND ART

When a bedridden patient wants to relieve themself of bodily fluids and waste, the common practice is to roll the patient on their side, place an open pan on the bed, and then roll the patient back onto the pan. This can be a very painful experience for a patient who has just had surgery, and most times the pan inserted is made of metal and is very cold to the touch of the skin. Then the patient's bed must be elevated to bring the patient into a somewhat sitting position. After relieving themself, the same steps must be repeated to move the patient off of the pan. Sometimes the contents of the pan may spill making it necessary to change the entire bed linens, as well as the patient's garment. There is also the chance that the attendant placing the patient on the pan may hurt themself by physical exertion if the patient is very large or unable to move or help the attendant in placing the pan.

Those concerned with these and other problems recognize the need for an improved method and apparatus for receiving fluids and wastes of bedridden patients.

DISCLOSURE OF THE INVENTION

The present invention provides an apparatus for receiving fluids and waste of a bedridden patient including a mattress with an elongated cavity in the middle, the cavity being the depth of the mattress and having an upper edge defined by the top surface of the mattress adjacent the cavity. A plug is selectively movable between an inserted position, which inserted position fills the cavity and makes the top surface of the mattress even. When the plug is in the retracted position, the cavity is open. A bottom sheet fitted over the mattress has a head portion, a foot portion and sides which cover the mattress. The bottom sheet also includes an opening registerable with the cavity in the mattress. An auxiliary short sheet is fitted over the bottom sheet and includes a body section that extends at least half way down the mattress to cover the plug. A waste container shorter than the longitudinal dimension of the cavity is also provided for inserting into the cavity of the mattress when the cavity is open. The invention further provides a method for receiving fluids and wastes from a bedridden patient which includes positioning the patient on the apparatus. The auxiliary short sheet is moved to expose the plug and the patient is positioned with legs astraddle the plug. The plug is removed from the cavity and the waste container is placed in the cavity and slid to the other end of the cavity in the mattress until the container is underneath the buttocks of the patient. After the patient has deposited body wastes in the container, the container is removed and the plug reinserted into the cavity opening. The auxiliary short sheet is then placed back in position to cover the plug.

An object of the present invention is the provision of an improved apparatus and method for receiving fluids and wastes of a bedridden patient.

Another object of the present invention is to provide an apparatus and method to collect bodily wastes of bedridden patients that allow the patient to remain undisburbed when inserting and removing the apparatus.

A further object of the invention is the provision of an apparatus that gives an even mattress when the plug is inserted.

Still another object is to provide an easy, uncomplicated insertion and removal process of the container.

A still further object of the present invention is the provision of an apparatus that can be inserted from the long dimension of the mattress, thus eliminating the necessity of rolling or lifting the patient to and from the bedpan.

Yet another object of the present invention is the provision of easy access to the mattress plug and cavity, again eliminating the need to move the patient.

A further object of the invention is the provision of a container that fits into the cavity and is even with the mattress, thereby eliminating uncomfortable postures.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 4 is an exploded perspective view showing the plug in a retracted position leaving the cavity open, the directional arrow indicating the plug being removed toward the foot of the mattress when retracted;

FIG. 5 is a top plan view of the plug;

FIG. 6 is an end elevational view of the plug;

FIG. 7 is a side elevational view of the plug;

BEST MODE FOR CARRYING OUT THE INVENTION

Figure 1:
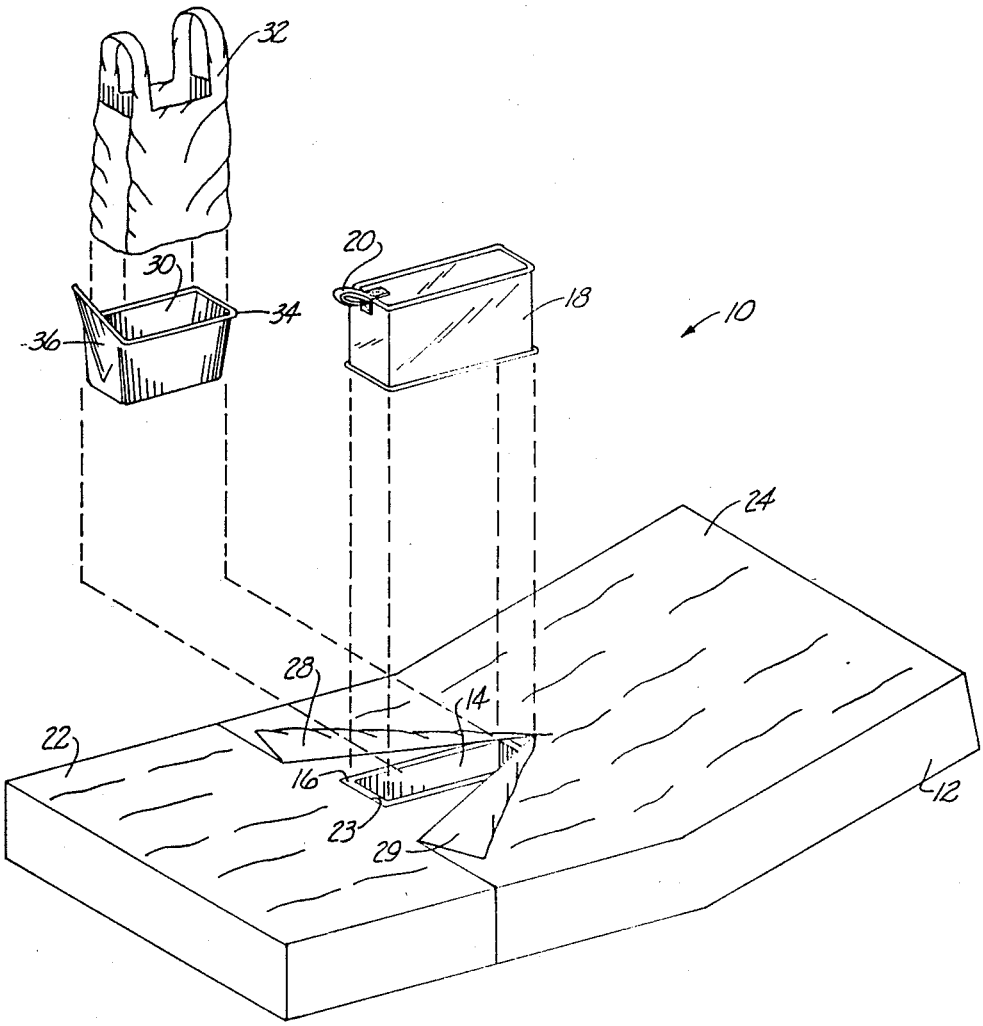
FIG. 1 is an exploded perspective view of the invention showing the auxiliary short sheet and bottom sheet in place on the mattress, and showing the plug in a retracted position leaving the cavity open and further showing the waste container and liner which are insertable into the open cavity in the mattress.

Referring now to the drawings, wherein like reference numerals designate identical or corresponding parts throughout the several views, FIG. 1 shows an apparatus (10) including a mattress (12) having an elongated cavity (14) generally in the middle thereof, the cavity having an upper edge (16) defined by the top surface of the mattress. The cavity (14) may be rectangular, rectangular with rounded corners or elliptical. A plug (18) with a loop (20) is also shown for insertion into and removal from the cavity (14). A bottom sheet (14) and an auxiliary short sheet (24) cover the mattress (12). The bottom sheet (22) is secured to the mattress (12) at the head portion and foot portion by means of an elastic material, as is well known in the art. The auxiliary short sheet (24) has a top section fitted over the head portion of the bottom sheet (22) by an elastic material. The body section of the auxiliary short sheet (24) extends at least half way down the mattress (12) and bottom sheet (22) to cover the plug (18) to keep a patient's bare skin from coming into contact with the plug (18).

Figure 2:
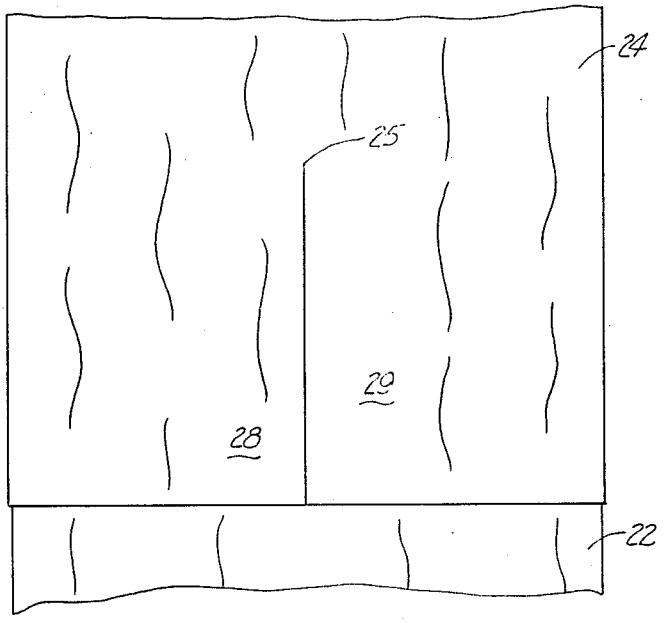
FIG. 2 is a partial top plan view of the auxiliary short sheet showing the slit opening including an overlapping flap and a bottom underlap.
Figure 3:
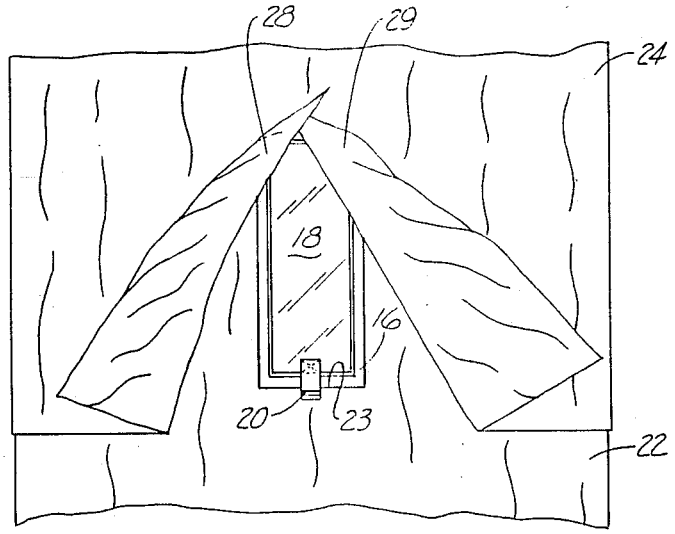
FIG. 3 is a top plan view of the auxiliary short sheet showing the flaps pulled back to expose the plug.

Referring to FIGS. 2 and 3, the auxiliary short sheet (24) is shown in FIG. 2 in a closed position covering a portion of the bottom sheet (22) and plug (18). Fg. 3 shows the auxiliary short sheet (24) in an open position with the overlappig flap (28) and underlapping flap (29) pulled back in an open position, thereby exposing the plug (18).

Referring now to FIG. 4, the plug (18) is shown being removed from the cavity (14) and moved toward the foot of the bed, thereby exposing the cavity (14) of the mattress (12) so the cavity (14) can receive a waste container (30).

Figure 8:
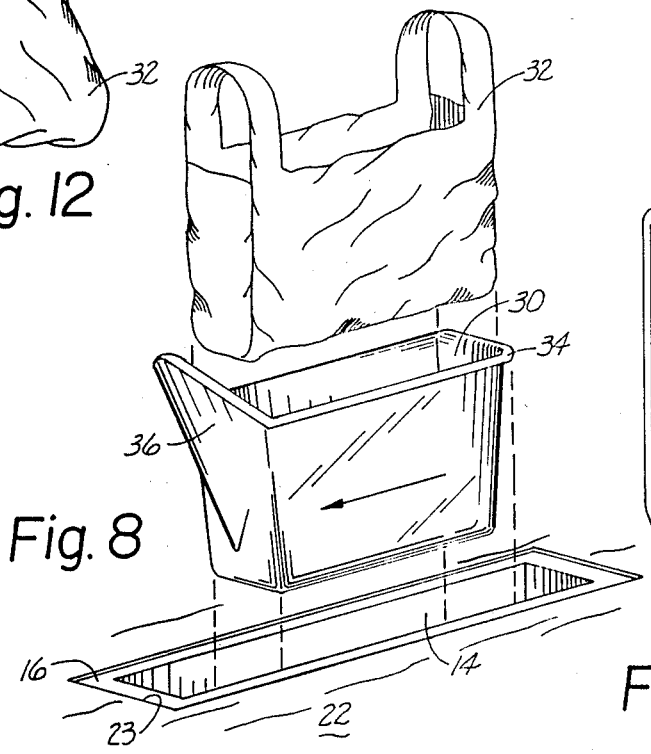
FIG. 8 is an exploded perspective view showing the waste container and liner in a retracted position, the directional arrow indicating the container being moved toward the foot of the mattress when retracted.
Figure 9:
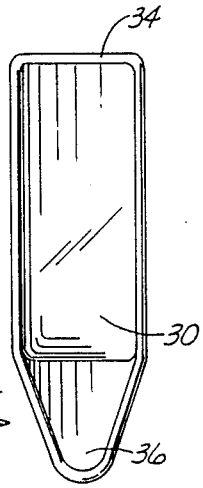
FIG. 9 is a top plan view of the waste container.
Figure 10:
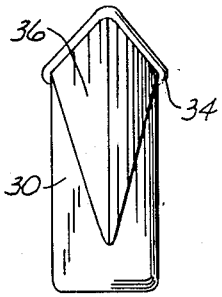
FIG. 10 is an end elevational view of the waste container.
Figure 11:
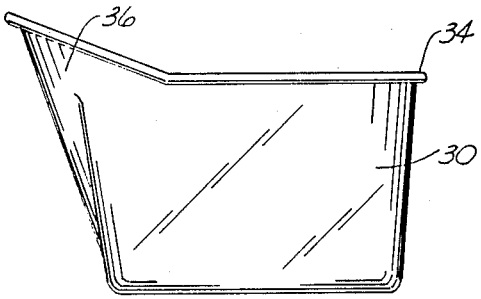
FIG. 11 is a side elevational view thereof.

FIG. 8 shows the waste container (30) with a removable liner (32) therein for receiving fluids and/or wastes from a patient (not shown). FIGS. 8 through 11 show the flanged top edge (34) of the waste container (30) from slipping to the bottom of the cavity (14). A handle (36) is disposed on one end of the waste container (30) for ease of insertion into and removal from the cavity (14). The handle (36) also serves as a splash shield.

Figure 12:
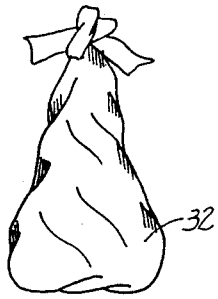
FIG. 12 is a perspective view of the liner removed from the waste container and tied with contents therein for disposal into an appropriate receptacle.

FIG. 12 shows the removable liner (32) removed from the container (30) and tied with the contents securely inside for proper disposal in an appropriate receptacle.

In use, a patient (not shown) is positioned on the mattress (12). The buttocks of the patient lie approximately at the top of the slit opening (25) of the auxiliary short sheet (24). The attendant pulls back each side of the overlapping (28) and underlapping (29) flaps of the auxiliary short sheet (24) to expose the plug (18). The attendant then positions the patient's legs, one on each side of the exposed plug (18). The attendant then grasps the loop (20) of the plug (18) to lift it out of the cavity (14) and move it towards the foot of the bed. A removable liner (32) is inserted into the waste container (30) and the container (30) is then inserted into the cavity (14) from the foot of the bed, and slid under the patient to the uppermost end of the cavity (14). The patient is allowed to relieve themself and the attendant then removes the waste container (30) with liner (32) from the cavity (14). The plug (18) is then reinserted into the cavity (14), the flaps (28 and 29) are pulled back together to cover the plug (18) and the patient's legs are positioned closer together, if desired.

The removable liner (32) is then tied securely by means of the extensions on the liner to secure the wastes of the patient therein. The liner (32) is then lifted out of the waste container (30) and disposed of in the proper receptacle.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. An apparatus for receiving fluids and wastes of bedridden patents consisting of:

a mattress having an elongated cavity formed generally in the middle thereof, said cavity being the depth of the mattress and having an upper edge defined by the top surface of the mattress adjacent said cavity;

a plug which is selectively movable between an inserted position wherein said plug fills the cavity and makes the top surface of the mattress even; and a retracted position wherein said plug is removed from said cavity to leave said cavity open; the plug extending lengthwise in the mattress and having head and foot ends thereof;

a bottom sheet having a head portion, a foot portion, and sides which cover the mattress, said bottom sheet having an opening registerable with said cavity;

an auxiliary sheet having a top section fitted over the head portion of the bottom sheet, and a body section extending only partially down the mattress a sufficient distance to cover said plug; the auxiliary sheet terminating adjacent the foot end of the plug; wherein, the auxiliary sheet includes both an overlapping flap and an underlapping flap movable between an open position and a closed position relative to said cavity wherein said overlapping flap overlies said underlapping flap in said closed position;

a waste container for inserting into the cavity of the mattress when said cavity is open, said container being shorter than the long dimension of the cavity to allow the container to be inserted into the cavity and then slide between the legs and then under the patient, wherein a longitudinal axis of the waste container is generally in alignment with the longitudinal axis of said mattress, eliminating the normal necessity of moving the patient for elimination to take place; wherein, the waste container has a flanged top edge which rests on the upper edge of the cavity to support the container from dropping to the bottom of the cavity and the waste container has one end extending higher than the opposite end to form a handle for ease of insertion into and removal from said cavity, and also to serve as a splash shield; and, a removable liner for said waste container for ease of disposal of waste contents deposited into said removable liner.

* * * * *